US009404277B2

(12) United States Patent
Ozum

(10) Patent No.: US 9,404,277 B2
(45) Date of Patent: Aug. 2, 2016

(54) APPARATUS FOR POSITIONING ANCHOR BOLTS

(71) Applicant: 1834032 Alberta Inc., Edmonton (CA)

(72) Inventor: Arda Ozum, Edmonton (CA)

(73) Assignee: 1834032 Alberta Inc., Edmonton (CA)

( * ) Notice: Subject to any disclaimer, the term of this patent is extended or adjusted under 35 U.S.C. 154(b) by 51 days.

(21) Appl. No.: 14/555,972

(22) Filed: Nov. 28, 2014

(65) Prior Publication Data

US 2016/0153207 A1 Jun. 2, 2016

(51) Int. Cl.
*G01B 5/25* (2006.01)
*E04G 21/18* (2006.01)

(52) U.S. Cl.
CPC ..... *E04G 21/185* (2013.01)

(58) Field of Classification Search
CPC ..... G01B 5/24; G01B 5/25; E04G 21/185
USPC ..... 33/562, 613, 645; 52/701
See application file for complete search history.

(56) References Cited

U.S. PATENT DOCUMENTS 3,150,429 A 9/1964 Shaffer
3,552,734 A * 1/1971 Severino ..... E04G 17/00 249/207
3,963,210 A 6/1976 Macklin
4,993,168 A * 2/1991 Acuna ..... B25H 7/04 33/42
5,060,436 A 10/1991 Delgado, Jr.
7,103,984 B2 9/2006 Kastberg
7,891,110 B2 * 2/2011 Diaz ..... E04B 1/4157 33/562
8,544,814 B2 10/2013 Diaz
2002/0095813 A1 * 7/2002 Tatarnic ..... G01C 15/02 33/613
2007/0215784 A1 9/2007 Beery
2007/0280788 A1 12/2007 Booth
2008/0265128 A1 10/2008 Hughes
2009/0000137 A1 * 1/2009 Diaz ..... E04G 21/185 33/562
2012/0324825 A1 * 12/2012 Vrame ..... E04B 1/38 52/745.21

FOREIGN PATENT DOCUMENTS

CA 2039437 9/1992
WO 95/25209 9/1995

* cited by examiner

*Primary Examiner* — G. Bradley Bennett
(74) *Attorney, Agent, or Firm* — Donald V. Tomkins

(57) ABSTRACT

Apparatus for positioning anchor bolts in formwork comprises a main body having a longitudinal slot, one or more bolt holders slidable within the slot and each adapted to hold a bolt, and two abutments slidable within the slot outboard of the bolt holders. The main body may be positioned on the formwork, with the abutments outboard of the formwork, and with the bolt holders in the main body slot. After the bolt holders have been laterally positioned relative to the formwork, with their abutments positioned against the formwork, the bolt holders and abutments may be fastened to the main body, and the main body attached to the formwork, thus holding the bolts in position relative to the formwork. In variant embodiments, either or both of the abutments may fixed to or integral with the main body, as may be the bolt holder.

13 Claims, 10 Drawing Sheets

APPARATUS FOR POSITIONING ANCHOR BOLTS

FIELD OF THE DISCLOSURE

The present disclosure relates in general to apparatus for positioning anchor bolts in concrete foundations.

BACKGROUND

It is commonly necessary to cast anchor bolts into concrete structures such as pile caps, equipment bases, and walls, for purposes of anchoring fixtures ranging from structural steel columns and heavy equipment for commercial and industrial buildings and other large structures, to wooden sill plates on residential foundation walls. Anchor bolts may be required to resist a variety of loads, such as uplift forces, out-of-plane lateral loads, and in-plane shear loads. In cases where anchor bolts by themselves would not provide the required load resistance, steel straps or plates or other appurtenances may need to be used in conjunction with the anchor bolts to transfer loads to the concrete structure.

Regardless of the specific purpose of the anchor bolts, it is always desirable and often critically important to ensure that the anchor bolts are held securely in position during construction, so that after the concrete has cured, the anchor bolts will be properly positioned and aligned to receive the fixtures they are intended to anchor. This entails positioning the anchor bolts accurately and securely in the formwork such that they are not susceptible to being knocked out of lateral position or angular alignment during placement of concrete in the formwork, and during related operations such as vibration of the freshly-placed concrete. Misplacement or misalignment of anchor bolts can result in the need for costly and time-consuming modifications to the concrete elements in which they have been cast and/or to the fixtures that they are intended to anchor.

There are many known methods and means for positioning anchor bolts in formwork. One simple and common method is to use anchor bolt templates made from dimension lumber (e.g., 2×6s, 2×8s, etc.) or plywood. In cases where multiple anchor bolts are required for anchoring a single fixture (such as the base plate for a structural column), the appropriate bolt pattern is marked out on the wooden template, and slightly oversize holes are drilled in the template to receive the anchor bolts. The bolts are then inserted into the holes in the templates, typically along with nuts and washers or other means to set the height that the bolts will project above the finished concrete. The assembly of the wooden template and anchor bolts is temporarily secured to the formwork, and then concrete can be placed in the formwork. In cases where individual anchor bolts are required at intermittent intervals, such as for anchoring a wooden sill plate to the top of a residential foundation wall (for supporting a wood-framed floor structure), the bolts can be positioned in holes in individual wooden templates temporarily secured to the wall forms.

These methods are satisfactory if carried out with proper care. Unfortunately, however, that often does not happen, and the result is anchor bolts that have been cast into the concrete in the wrong position in one or both lateral directions, and/or out of angular alignment, due to factors such as inaccurate marking and drilling of bolt-receiving holes in the wooden templates, and inaccurate or insufficiently secure positioning of the templates on the formwork.

Various types of anchor bolt positioning devices are commercially available, but they can be expensive or comparatively difficult to use. Accordingly, there is a need for anchor bolt positioning apparatus that is inexpensive and simple to use, while reducing the chances of error with respect to the positions of anchor bolts in finished concrete structures.

BRIEF SUMMARY

In a first aspect, the present disclosure teaches a bolt-positioning apparatus for holding anchor bolts in desired lateral positions and angular alignments while being cast into a concrete foundation. In one embodiment, the bolt-positioning apparatus comprises three primary components:

- an elongate main body defining a longitudinal slot bounded by elongate side members;
- at least one bolt-holding element (alternatively referred to herein as a bolt holder) slidably disposable within the longitudinal slot in the main body and adapted to receive an anchor bolt (typically by providing a hole extending through the bolt holder); and
- two abutment elements slidably disposable within the longitudinal slot in the main body.

The bolt holders and the abutment elements of this particular embodiment include stop means for setting the vertical positions of these components relative to the main body. In one variant, the stop means comprises a flange extending laterally outward from an upper region of the bolt holder or abutment element (as the case may be), such that the flange will rest on an upper surface of the main body. When the bolt holder is thus positioned in the longitudinal slot in the main body, the lowermost portion of the bolt holder will not project below the main body. However, each abutment element preferably has a lower portion which, for reasons explained below, extends below the main body when the abutment element is disposed within the longitudinal slot with its stop means resting on the main body.

To use the bolt-positioning apparatus, the main body is positioned on the formwork for the pile cap or other foundation element into which anchor bolts are to be cast, with the slidable abutment elements positioned outboard of and on opposite sides of the formwork. One or more bolt holders are positioned in the longitudinal slot in the main body, and an anchor bolt is installed in each bolt holder (either before or after the main body is positioned on the formwork). The anchor bolts may be conveniently retained in their respective bolt holders by means of nuts installed on the threaded portions of the bolts extending above the bolt holders (or by any other suitable means).

The main body is mounted on the formwork in a desired position in a direction transverse to its longitudinal slot. The main body may then be fixed in this position relative to the formwork by sliding each of the abutment elements up against the formwork and fixing the abutments to the formwork by any suitable means (such as, in preferred embodiments, by nailing or stapling the lower portions of the abutments to the formwork). The flanges (or other stop means) of the abutments can be nailed or stapled to the upper surface of the main body, at a suitable stage of the process, to fix the position of the main body in its longitudinal direction.

The bolt holder(s) may be slid within the slot in the main body to reach a desired longitudinal position relative to the formwork. Optionally, the main body may be provided with a printed linear scale to facilitate quick and accurate positioning of the bolt holders in the slot. Once in their desired positions, the bolt holders may be fixed to the main body by nailing or stapling their stop means to the main body. At this stage, the bolt-positioning apparatus is fully assembled and securely mounted on the formwork, which is then ready to receive concrete.

The above-described sequencing of the steps in assembling and mounting the bolt-positioning apparatus is by way of example only, and the required steps could be performed in different sequences to achieve desired results. To provide one example, the one or more bolt holders could be installed in and fixed to the main body before the main body is positioned on the formwork.

After the concrete wall or other foundation element has been cast and has sufficiently cured, the bolt-positioning apparatus can be removed by removing the nuts on the projecting anchor bolts, removing the nails, staples, or other fastening means used to fix the abutment elements to the formwork, and then lifting the apparatus off of the foundation.

The bolt-positioning apparatus may be fabricated or formed from any suitable material, including but not limited to pressed metal, timber, formed plastic, wax-coated cardboard, pressed paper, and/or pressed wood fiber. Depending on the material used, the apparatus may be reusable. Alternatively, the material used may dictate that the apparatus is suitable for one use only, such as when its components are made from cardboard or similar materials—in which case the apparatus could be simply torn off the formwork (or knocked off with a hammer or other suitable tool) after the concrete has cured.

Alternative embodiments of the bolt-positioning apparatus described above may have one sliding abutment element and one abutment element integral with or otherwise fixed to the main body. Other embodiments may have two fixed abutment elements, spaced to suit formwork of specific dimensions.

In a second aspect, the present disclosure teaches an anchor bolt holder primarily intended for (but limited to) holding an anchor bolt in a desired lateral position and angular alignment while being cast into the top of a concrete foundation wall. In alternative embodiments, this device could be adapted to hold more than one anchor bolt, and such alternative embodiments are intended to come within the scope of this disclosure. However, this device would most commonly be used in conjunction with a single anchor bolt, as illustrated in the related accompanying Figures, for anchoring sill plates to foundation walls. To distinguish this device from components of the bolt-positioning apparatus described previously, it will be alternatively referred to herein as a sill anchor holder.

In typical residential construction, a wood-framed main floor structure is constructed on top of concrete foundation walls. A 2×6 or 2×8 wooden sill plate is anchored to the top of each foundation wall, and then a wood joist floor structure is built on and anchored to the sill plates. The connection between the floor joists and the foundation walls, through the sill plates, must safely withstand uplift forces that may act on the superstructure due to wind. As well, lateral loads from external soil pressure (which could be intensified by vertical surcharge loading on adjacent soil surfaces), and in some cases hydrostatic pressure acting on the foundation walls, must be reacted through the floor-to-wall connections to provide lateral support to the foundation walls. Therefore, anchorage of the sill plates to the foundation walls is critical to the strength and safety of the completed structure.

Sill plate anchor bolts may be provided in the form of expansion anchors or wedge anchors (e.g., Hilti® bolts) installed after the foundation walls have cured. However, accurate positioning of such anchors can be a problem. More commonly, sill plate anchor bolts are cast into the walls using wooden templates, and as previously noted, this practice can lead to mislocated bolts if not carried out with sufficient care.

The sill anchor holder disclosed herein ensures accurate anchor bolt placement relative to the width of the foundation wall, while being simple and quick to install on the formwork for the wall. The device comprises a main body extending between a pair of abutments, which extend below the main body and are spaced apart by a distance corresponding to the outer width of the wall forms. For example, for an 8-inch concrete wall constructed with ½-inch plywood form panels, the face-to-face distance between the abutments would be 9 inches (preferably plus a tolerance to allow for small variations in the width of the formwork assembly). In alternative embodiments, one or both of the abutments could be made adjustable to facilitate mounting the sill anchor holder on wall forms having significant dimensional irregularities.

In one embodiment, a suitably-sized hole for receiving an anchor bolt is provided in the main body at a fixed distance relative to the abutments. For example, if it is desired for the anchor bolt to be cast on the centerline of a concrete wall, the anchor bolt hole in the main body would be equidistant from the two abutments (making the device impossible to mount "backwards" on the formwork). However, if it is desired for the anchor bolt to be offset from the wall centerline, the position of the anchor bolt hole in the main body would be adjusted accordingly. In variant embodiments, the main body could be provided with multiple anchor bolt holes, such that the same embodiment of the anchor holder could be used for positioning anchor bolts at different distances from the face of the finished wall.

Regardless of the position and number of anchor bolt holes provided in the main body, methods for installing the sill anchor holder on foundation wall formwork would be essentially the same. Since the distance between the abutments of the sill anchor holder corresponds to the width of the wall forms, it is a simple matter to place the anchor holder over the top of the wall forms with the abutments extending downward alongside the outer faces of the form panels, and then after ensuring that it is in the desired position along the length of the wall, to fix the sill anchor holder to the form panels by nailing or stapling the abutments to the form panels (or using any other suitable attachment means, including but not limited to wood screws). When all required sill anchor holders are in place, and anchor bolts have been installed in all of them (either before or after installation of the sill anchor holders on the formwork), placement of concrete in the wall forms can begin.

After the concrete wall has cured, the sill anchor holders can be easily removed from the forms by removing the nuts or other means used to retain the anchor bolts in the anchor holders, breaking the connection between the abutments and the form panels, and then lifting the anchor holders off of their respective anchor bolts and off of the forms. In the case of single-use embodiments made from weaker materials such as cardboard, pressed paper, or pressed wood fiber, or cardboard, the sill anchor holders can be simply ripped off of the forms manually, with the aid of hand tools if necessary, without needing at that stage to remove any nuts or other bolt-retaining means that might have been installed in association with the anchor bolts.

In a variant of the sill anchor holder that is particularly adapted for providing enhanced resistance to uplift and lateral forces, the main body of the anchor holder is adapted to receive a metal strap anchor, one end of which has a hole whereby the strap anchor can be installed on a corresponding anchor bolt, and the other end of which has fastener holes for receiving nails or screws for connecting the strap anchor to a wood floor structure built on a sill plate secured to a foundation wall by the anchor bolt. Such strap anchors could of course be installed on the anchor bolts after the foundation wall has been cast and cured. However, mounting the strap anchors on the anchor bolts in conjunction with sill anchor holders during the process of casting the wall can provide practical advantages in terms of construction efficiency, because the wall is ready to receive sill plates immediately after the forms are stripped.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Bolt-Positioning Apparatus with Sliding Bolt Holders

Figure 1:
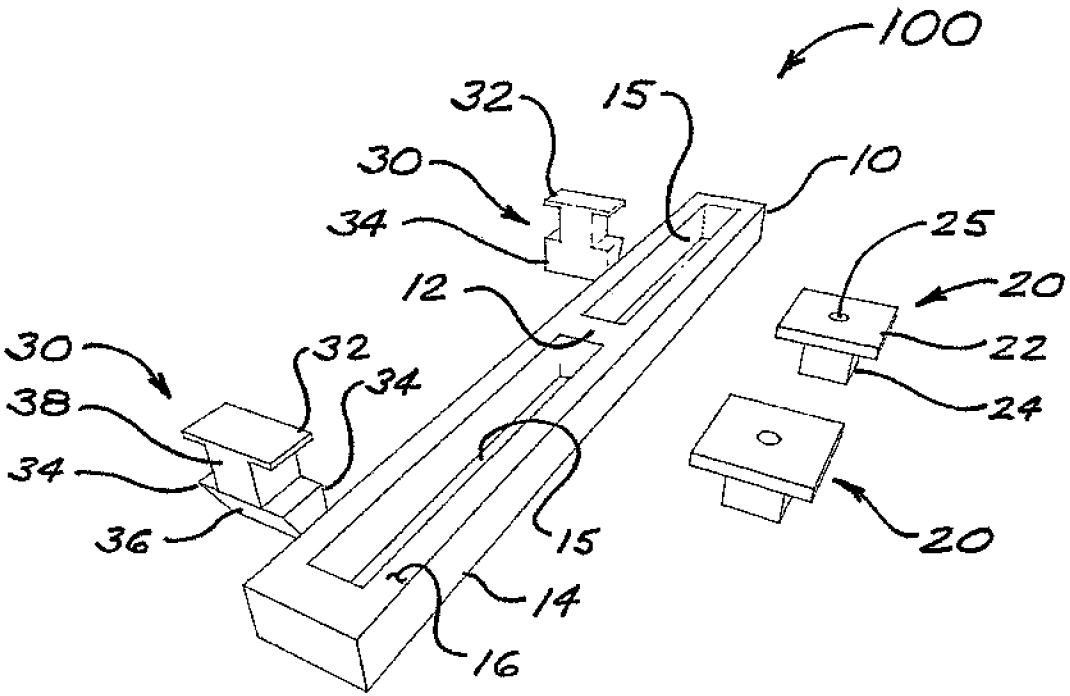
FIG. 1 is a perspective view of the primary components of a first embodiment of a bolt-positioning apparatus in accordance with the present disclosure.
Figure 2:
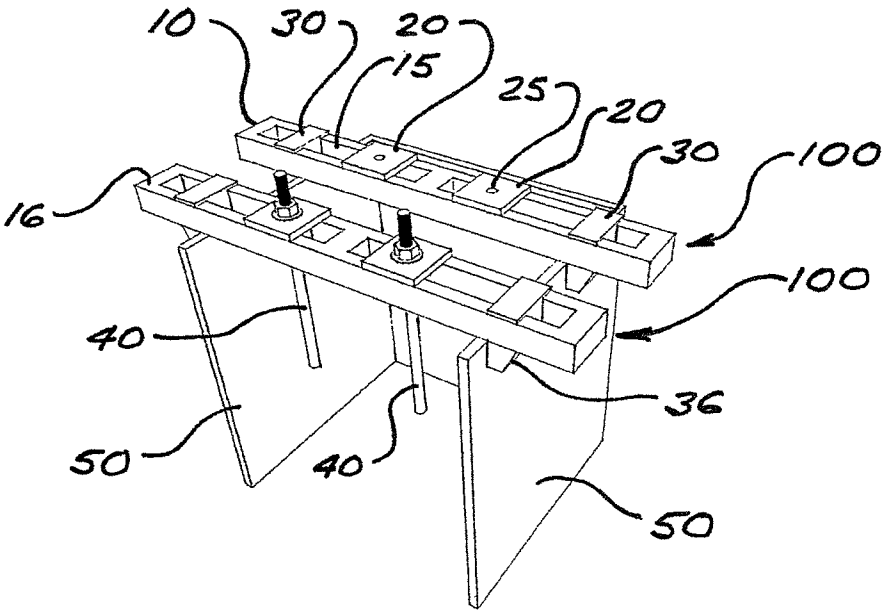
FIG. 2 is a cutaway perspective view of the bolt-positioning apparatus of FIG. 1 mounted on formwork for a concrete foundation element, with anchor bolts installed in the bolt holders of the apparatus.
Figure 3:
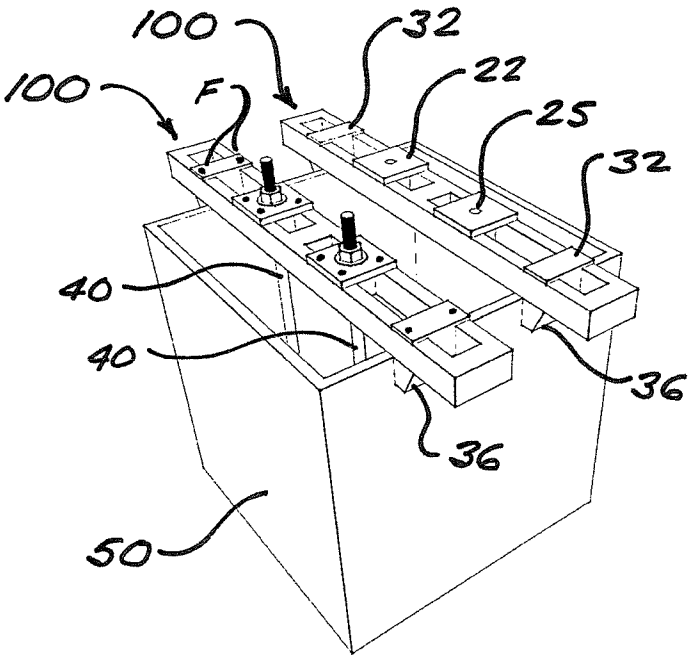
FIG. 3 is a non-cutaway perspective view of the assembly in FIG. 2.

FIGS. 1-3 illustrate a bolt-positioning apparatus 100 particularly adapted for positioning multiple anchor bolts in the formwork for a concrete structure, such as a cluster of anchor bolts in a pile cap or pilaster for receiving the base plate of a structural building column. FIG. 1 illustrates the main components of one embodiment of apparatus 100, as follows:

- an elongate main body 10 having a longitudinal slot 15 (which for strength purposes may optionally be subdivided into two or more sections by one or more spacer elements 12);
- one or more bolt-holding elements (alternatively referred to herein as "bolt holders") 20, each having:
  - a lower section 24;
  - bolt holder fastening means, for facilitating fastening of bolt holder 20 to main body 10, which bolt holder fastening means may be provided, by way of non-limiting example, in the form of a tab or flange element 22 projecting laterally from an upper region of lower section 24; and
  - a typically vertical bolt-receiving hole 25 extending through lower section 24 of each bolt holder 20, and with bolt holder 20 being slidably disposable within slot 15 of main body 10; and
- two abutment elements 30, each comprising:
  - a middle section 38, configured to be slidably disposable within slot 15 of main body 10;
  - abutment fastening means, for facilitating fastening of abutment 30 to main body 10, which abutment fastening means may be provided, by way of non-limiting example, in the form of a tab or flange element 32 projecting laterally from an upper region of middle section 38; and
  - a lower section 36 extending downward from middle section 38, and optionally having one or more lateral projections 34 (for preventing vertical displacement of abutment 30 relative to main body 10 after being installed in slot 15).

FIGS. 2 and 3 illustrate a pair of bolt-positioning apparatus 100 mounted on a formwork assembly 50, with anchor bolts 40 positioned in bolt holders 20. FIG. 3 shows the apparatus 100 after bolt holders 20 (and bolts 40) have been laterally positioned as desired relative to the fully-assembled formwork 50, with lower sections 36 of abutments 30 positioned against formwork 50, and with flange 22 of each bolt holder 20 and flange 32 of each abutment 30 fastened to the associated main body 10, and with lower section 36 of each abutment fastened to formwork 50 (all by means of suitable fasteners representatively indicated by reference character F in FIG. 3).

Slot 15 of main body 10 is shown in FIGS. 1-3 as having a uniform transverse width, closely corresponding to the width of lower section 24 of bolt holder 20 and middle section 38 of abutment 30. However, this is by way of non-limiting example only. In variant embodiments, slot 15 optionally may include a section of increased width, such as for example in the case where abutment 30 includes lateral projections 34, to facilitate insertion of abutment 30 into slot 15. This may be particularly advantageous in cases where abutment 30 is made of metal or some other comparatively rigid material.

In cases where abutment 30 is made of a softer material, such as cardboard or pressed paper, however, abutment 30 can be configured with a longitudinal dimension allowing it to be inserted sideways into slot 15 and then twisted 90 degrees to its final position, as any distortion of abutment 30 that might occur during this procedure would not affect its essential functionality. In such cases, it would not be necessary for slot 15 to have a section of increased width for purposes of installing abutment 30.

Lower section 24 of bolt holder 20 is shown in FIGS. 1-3 as being of constant rectilinear cross-section, but this is by way of example only. In variant embodiments, lower section 24 could optionally incorporate one or more lateral projections that are slidable within receiving grooves or channels formed in main body 10, so as to retain bolt holder 20 in main body 10. In such variant embodiments, it would be advantageous for slot 15 to have a section of increased width to facilitate installation of bolt holder 20.

Sill Anchor Holder

FIGS. 4-10 illustrate an embodiment of a bolt-positioning apparatus particularly adapted for positioning anchor bolts in the formwork for a concrete wall, such as for the purpose of anchoring a wooden sill plate to the top of the wall. Bolt-positioning apparatus of this type will be referred to herein as sill anchor holders.

Figure 4:
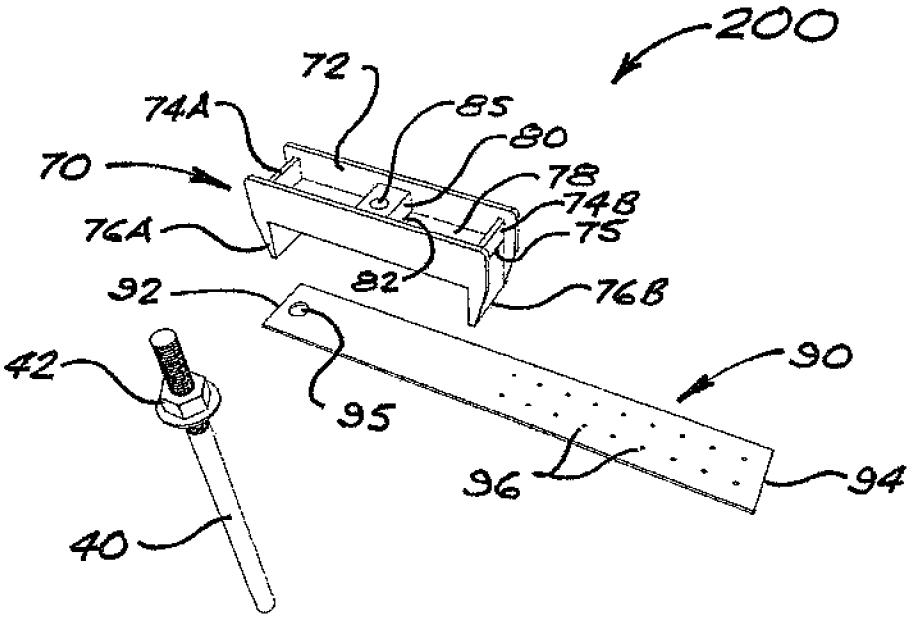
FIG. 4 illustrates a first embodiment of a sill anchor holder in accordance with the present disclosure, along with an anchor bolt and a strap anchor usable in conjunction with the sill anchor holder.

FIG. 4 illustrates a sill anchor assembly 200, including a sill anchor holder 70 (alternatively referred to as the main body of the sill anchor holder) having:

- a pair of spaced sidewalls 72;

a first endwall 74A and a second endwall 74B extending between sidewalls 72 at opposite ends of sill anchor holder 70;

a first abutment 76A and a second abutment 76B extending downward, respectively, from first and second endwalls 74A and 74B;

optionally, a floor plate 78 bounded by sidewalls 72 (and, optionally, by one or both of endwalls 74A and 74B); and a bolt-holding element 80 position between sidewalls 72, with a typically vertical bolt hole 85 extending through bolt-holding element 80 and in a selected linear location relative to endwalls 74A and 74B.

As shown in FIG. 4, sill anchor assembly 200 may optionally include an elongate strap anchor 90 having a first end 92, a second end 94, a bolt hole 95 proximal to first end 92, and one or more fastener holes 96 proximal to second end 94. Strap anchor 90 is shown as being of rectilinear configuration, but this is by way of non-limiting example only. In variant embodiments, strap anchor 90 could be of other shapes while still coming within the scope of the present disclosure. For example, second end 94 of strap anchor 90 could be flared (or "whale-tailed") to facilitate provision of additional fastener holes 96.

Figure 5:
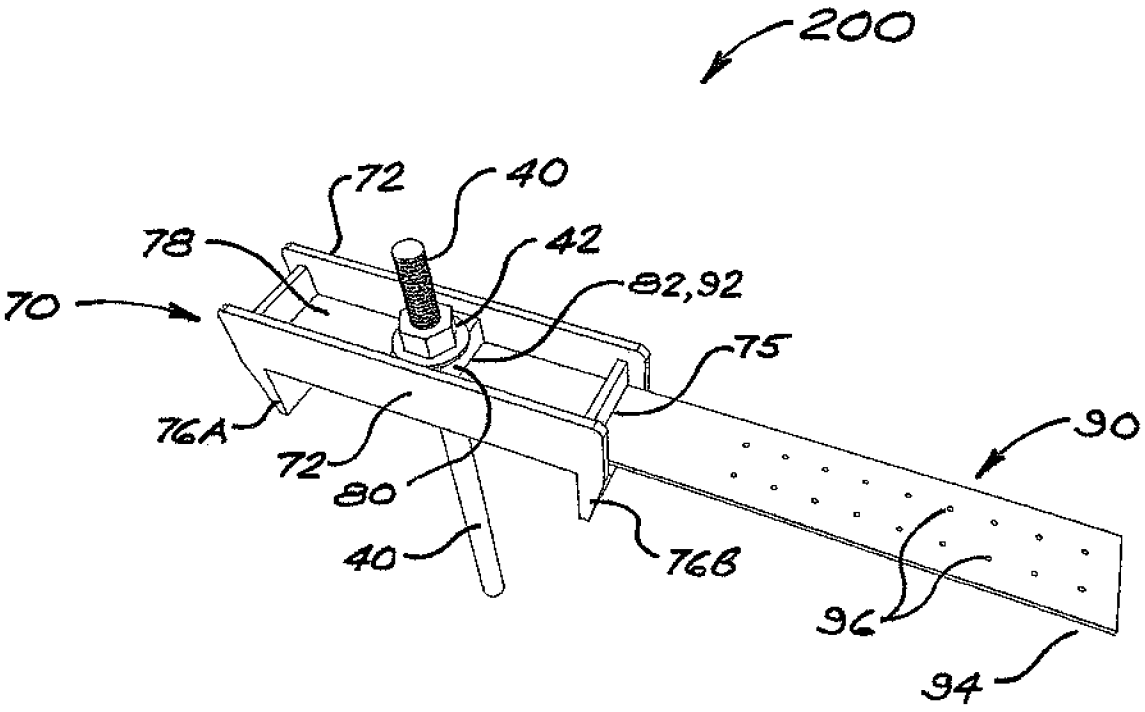
FIG. 5 is a perspective view of a sill anchor holder as in FIG. 4, carrying an anchor bolt and a strap anchor.

In embodiments of sill anchor holder 70 intended for use with a strap anchor 90, second endwall 74B may be provided with a transversely-oriented slot 75 and bolt-holding element 80 similarly may be provided with a transversely-oriented slot 82, as shown in FIG. 4. FIG. 5 illustrates sill anchor assembly 200 with first end 92 of strap anchor 90 inserted into slot 75 in second endwall 74B and then into slot 82 in bolt-holding element 80 such that bolt hole 95 in strap anchor 90 is aligned with bolt hole 85 in bolt-holding element 80, and such that an anchor bolt 40 inserted through bolt holes 85 and 95 will retain strap anchor 90 within sill anchor holder 70.

Figure 6:
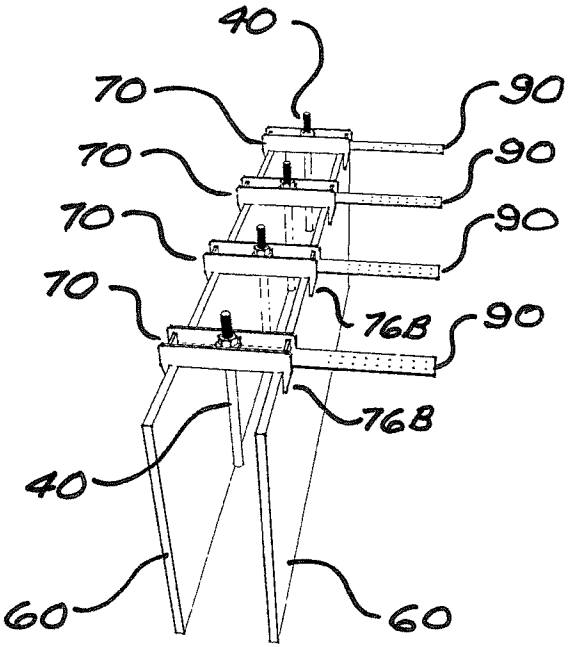
FIG. 6 is a perspective view of formwork for a foundation wall, with sill anchor holders carrying anchor bolts and strap anchors as in FIG. 5 mounted thereon.
Figure 7:
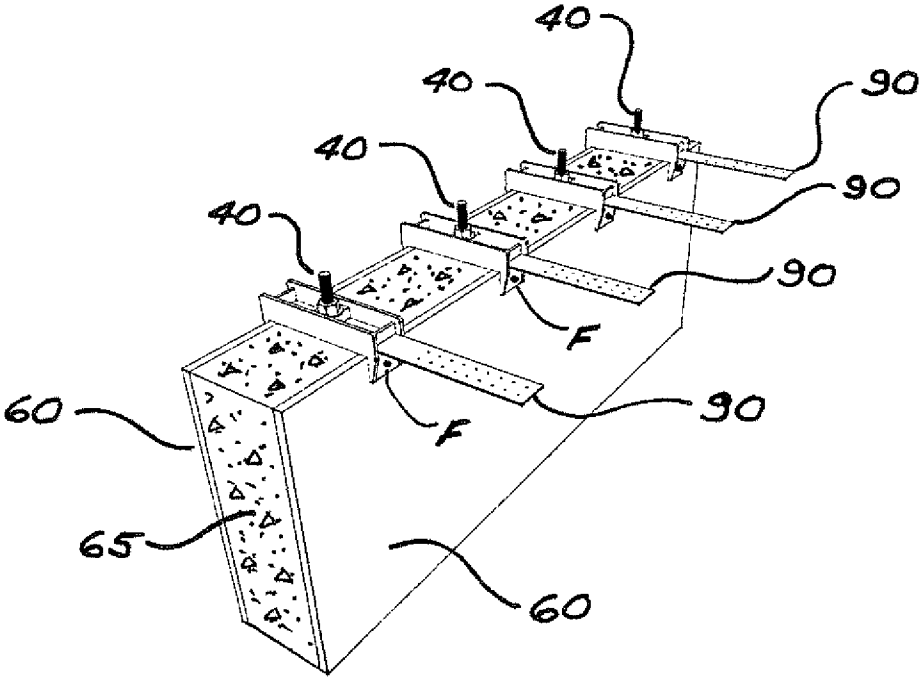
FIG. 7 is a perspective view of the assembly in FIG. 6 after the concrete foundation wall has been cast.

FIG. 6 illustrates a section of formwork 60 for a concrete wall, with a number of sill anchor assemblies 200 mounted thereon, at desired intervals along the length of the wall. In the illustrated embodiment, the distance between abutments 76A and 76B of sill anchor holders 70 has been set to match the width of formwork 60, such that when sill anchor holders 70 are positioned on formwork 60, abutments 76A and 76B will be closely adjacent to or in contact with the exterior surfaces of the corresponding formwork panels. After all sill anchor assemblies 200 are in their desired positions on formwork 60, they may be fixed to formwork 60 by means of nails, staples, or other suitable fasteners F connecting abutments 76A and 76B to the formwork panels, as seen in FIG. 7. The completed formwork/anchor bolt assembly is then ready to receive concrete to create concrete wall 65 as shown in FIG. 7.

Figure 8:
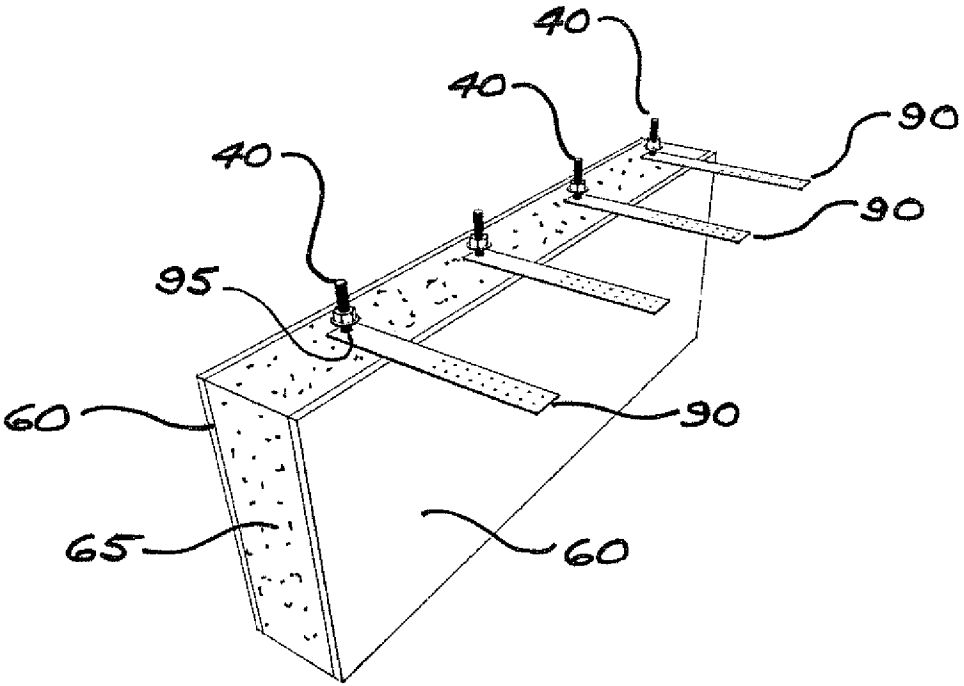
FIG. 8 is a perspective view of the assembly in FIG. 7 after removal of the sill anchor holders from the formwork.

After concrete wall 65 has cured, all sill anchor holders 70 may be removed from formwork 60, leaving anchor bolts 40 projecting from the top of wall 65 and, when strap anchors 90 are being used in conjunction with anchor bolts 40, with strap anchors 90 projecting laterally from wall 65 (typically toward the exterior of wall 65). This is illustrated in FIG. 8.

Figure 9:
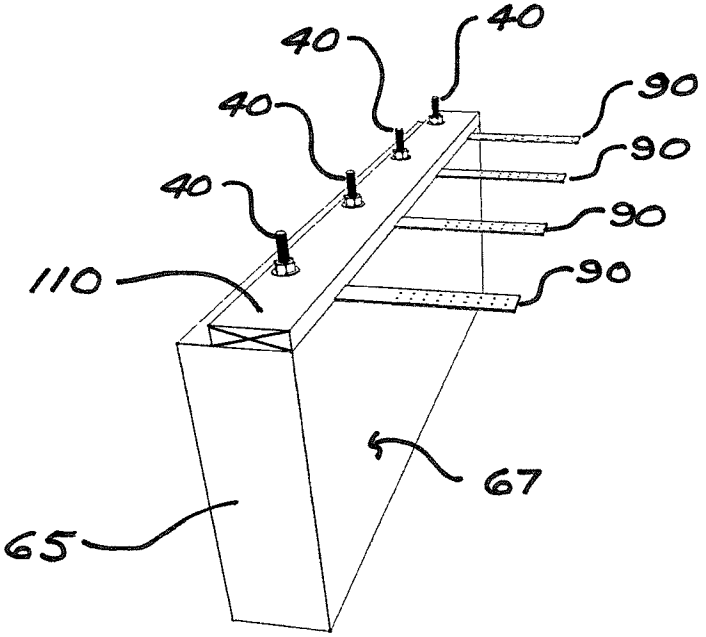
FIG. 9 is a perspective view of the foundation wall in FIG. 8 after removal of the formwork, and with a sill plate being installed on the sill plate anchor bolts.

FIG. 9 illustrates concrete wall 65 after formwork 60 has been stripped, with strap anchors 90 projecting outward from the exterior surface 67 of wall 65, and with a pre-drilled wooden sill plate 120 mounted over anchor bolts 40 (and over first ends 92 of strap anchors 90).

Figure 10:
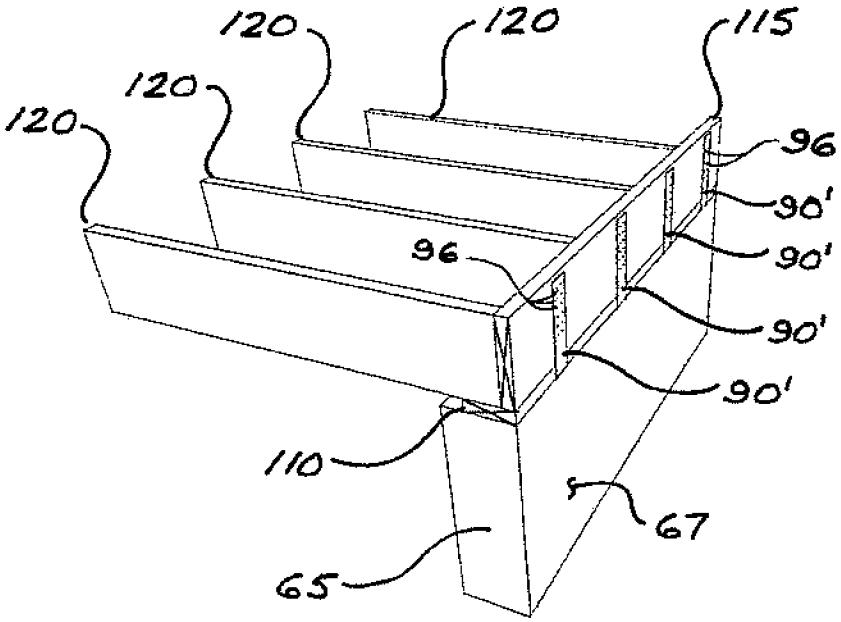
FIG. 10 is a perspective view as in FIG. 9 after installation of a wood joist floor structure on the sill plate, with the strap anchors bent up and fastened to an exterior header joist.

In FIG. 10, a wood joist floor structure has been constructed, with the ends of wood joists 120 bearing on sill plate 110, and with a header joist 115 running transversely along the ends of joists 120 and the outer edge of sill plate 110, such that the outer face of header joist 115 is in approximately the same plane as exterior surface 67 of wall 65. The projecting portions of strap anchors 90 have been bent upward against header joist 115 (with reference character 90' denoting the upwardly-bent sections of strap anchors 90), so that nails, screws, or other suitable fasteners can be installed through fastener holes 96 in bent-up sections 90' and into header joist 115, thus anchoring the floor structure against both lateral displacement and uplift relative to wall 65.

In the illustrated embodiment, abutments 76A and 76B are at a fixed spacing, to suit wall formwork assemblies having a constant outside dimension. As noted previously, however, in alternative embodiments of sill anchor holder 70, one or both of the abutments could be made movable relative to main body 10, such that the distance between the first and second abutments is adjustable, to facilitate mounting the sill anchor holder on wall forms having significant dimensional irregularities.

Also as previously noted, variant embodiments of sill anchor holder 70 may have multiple anchor bolt holes, such that the same embodiment of sill anchor holder could be used for positioning anchor bolts at different distances from the face of the finished wall. As well, other variants of sill anchor holder 70 may have a bolt-holding element that is slidable within a slot (in the same general manner as bolt holder 20 is slidable within slot 15 of main body 10 of bolt-positioning apparatus 100), or otherwise movable relative to main body 10, such that it possible to position an anchor bolt at any of a variety of different locations within sill anchor holder 70.

It will be readily appreciated by those skilled in the art that various modifications to embodiments in accordance with the present disclosure may be devised without departing from the present teachings, including modifications which may use materials later conceived or developed. It is to be especially understood that the scope of the claims appended hereto should not be limited by any particular embodiments described or illustrated herein, but should be given the broadest interpretation consistent with the disclosure as a whole. It is also to be understood that the substitution of a variant of a claimed element or feature, without any substantial resultant change in functionality, will not constitute a departure from the scope of the disclosure or the claims.

In this patent document, any form of the word "comprise" is intended to be understood in a non-limiting sense, meaning that any item following such word is included, but items not specifically mentioned are not excluded. A reference to an element by the indefinite article "a" does not exclude the possibility that more than one such element is present, unless the context clearly requires that there be one and only one such element. Any use of any form of any term describing an interaction between elements is not meant to limit the interaction to direct interaction between the elements in question, but may also extend to indirect interaction between the elements such as through secondary or intermediary structure.

Relational terms such as but not limited to "vertical" are not intended to denote or require absolute mathematical or geometrical precision. Accordingly, such terms are to be understood as denoting or requiring substantial precision only (e.g., "substantially vertical" or "generally vertical") unless the context clearly requires otherwise. Any use of any form of the term "typical" is to be interpreted in the sense of being representative of common usage or practice, and not as implying essentiality or invariability.

What is claimed is:

1. An apparatus for positioning anchor bolts, said apparatus comprising:

(a) an elongate main body having a longitudinal slot;

(b) one or more bolt holders, each comprising:

b.1 a lower section slidably disposable within the longitudinal slot of the main body, and having a hole for receiving a bolt; and b.2 bolt holder fastening means, to facilitate fastening of the bolt holder to the main body; and (c) two abutments, wherein at least one abutment is a slidable abutment comprising:

c.1 a middle section slidably disposable within the longitudinal slot of the main body;

c.2 a lower section extending downward from said middle section; and c.3 abutment fastening means, to facilitate fastening of the slidable abutment to the main body.

2. An apparatus as in claim 1 wherein one of the abutments is fixed to or integral with the main body.

3. An apparatus as in claim 1 wherein the bolt holder fastening means comprises a flange projecting laterally from an upper region of the lower section of the bolt holder.

4. An apparatus as in claim 1 wherein the abutment fastening means of the slidable abutment comprises a flange projecting laterally from an upper region of middle section of the slidable abutment.

5. An apparatus as in claim 1 wherein at least one of the abutments has a lower section extending downward from the middle section.

6. An apparatus as in claim 5, further comprising one or more lateral projections associated with the lower section of the abutment.

7. An apparatus as in claim 1 wherein the main body is made at least in part from a material selected from the group consisting of pressed metal, timber, formed plastic, wax-coated cardboard, pressed paper, and/or pressed wood fiber.

8. An apparatus for positioning an anchor bolt, said apparatus comprising an elongate main body, said main body having:

(a) a pair of spaced sidewalls;

(b) a first endwall and a second endwall each extending between said sidewalls at opposite ends of the main body;

(c) a first abutment extending downward from the first endwall, and a second abutment extending downward from the second endwall; and (d) a bolt-holding element positioned between said sidewalls, with a bolt hole extending therethrough in a selected location relative to said endwalls.

9. An apparatus as in claim 8, further comprising a floor plate extending between the sidewalls.

10. An apparatus as in claim 8 wherein the second endwall has a transversely-oriented slot and the bolt-holding element has a corresponding transversely-oriented slot, said slots being configured to receive a strap anchor.

11. An apparatus as in claim 8 wherein at least one of said first and second abutments is movable relative to the main body, such that the distance between the first and second abutments is adjustable.

12. An apparatus as in claim 8 wherein the bolt-holding element is movable relative to the main body, such that the respective distances between the bolt hole and the abutments are adjustable.

13. An apparatus as in claim 8 wherein the main body is made at least in part from a material selected from the group consisting of pressed metal, timber, formed plastic, wax-coated cardboard, pressed paper, and/or pressed wood fiber.

* * * * *